US010752489B1

(12) United States Patent
Alger

(10) Patent No.: US 10,752,489 B1
(45) Date of Patent: Aug. 25, 2020

(54) TAP TOWER AND KEG TAP ALERT SYSTEM COMBINATION

(71) Applicant: Jason J. Alger, Georgetown, CA (US)

(72) Inventor: Jason J. Alger, Georgetown, CA (US)

( * ) Notice: Subject to any disclaimer, the term of this patent is extended or adjusted under 35 U.S.C. 154(b) by 0 days.

(21) Appl. No.: 16/520,009

(22) Filed: Jul. 23, 2019

(51) Int. Cl.
*B67D 1/08* (2006.01)

(52) U.S. Cl.
CPC ..... *B67D 1/0888* (2013.01); *B67D 1/0841* (2013.01); *B67D 1/0891* (2013.01)

(58) Field of Classification Search
CPC ..... B67D 1/0841; B67D 1/0891; B67D 7/08; B65D 2203/04; G06M 1/041; G01F 23/00
USPC ..... 222/23
See application file for complete search history.

(56) References Cited

U.S. PATENT DOCUMENTS 2,127,875 A * 8/1938 Lippert ..... B67D 1/0829 137/100
4,406,382 A * 9/1983 Roth ..... B67D 1/1247 137/551
4,979,641 A 12/1990 Turner
5,007,560 A 4/1991 Sassak
5,303,845 A * 4/1994 Osawa ..... B67D 1/1252 222/1
5,769,271 A * 6/1998 Miller ..... B67D 1/06 222/1
6,003,542 A 12/1999 Pizzacalla
7,096,617 B2 8/2006 Bydalek
D555,974 S 11/2007 Miller
8,925,382 B1 * 1/2015 Beal ..... G01F 23/14 73/299
9,221,667 B2 12/2015 Hershberger
2005/0047143 A1 3/2005 Currie
2006/0011650 A1 * 1/2006 Gomi ..... B67D 1/0406 222/23
2008/0189078 A1 * 8/2008 Vok ..... B67D 1/0842 702/188
2011/0168775 A1 * 7/2011 Van Zetten ..... B67D 1/0888 235/381
2012/0059513 A1 * 3/2012 Perkins ..... B67D 1/0406 700/244
2015/0211909 A1 * 7/2015 Murphy ..... G01F 23/185 702/55
2016/0355389 A1 * 12/2016 Bursey ..... B67D 1/0884
2019/0071298 A1 * 3/2019 Tomforde ..... G06Q 20/18
2020/0055720 A1 * 2/2020 Volftsun ..... B67D 1/1272

FOREIGN PATENT DOCUMENTS

WO WO2016089389 6/2016

* cited by examiner

*Primary Examiner* — Benjamin R Shaw

(57) ABSTRACT

A tap tower and keg tap alert system combination for alerting bartenders when a beer keg is running low or empty includes a coupler that is configured to selectively engage a beer keg, a first hose coupled to the coupler that is in fluid communication with the coupler, and a sensor coupled to the first hose. The sensor utilizes a flow sensor to detect flow volume and pressure of beer in the hose. A battery is used for power. A second hose is coupled to the sensor and a tap faucet of a tap tower. An indicator is coupled to the sensor that is in operational communication with an LED light coupled within the tap tower. The LED light is configured to shine green, orange, and alternatively, red, when pressure and volume detected indicate the beer keg is good, nearing empty, and empty, respectively.

17 Claims, 4 Drawing Sheets

TAP TOWER AND KEG TAP ALERT SYSTEM COMBINATION

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98.

The disclosure and prior art relates to keg taps and more particularly pertains to a new keg tap for alerting bartenders when a beer keg is running low or empty.

BRIEF SUMMARY OF THE INVENTION

An embodiment of the disclosure meets the needs presented above by generally comprising a coupler that is configured to selectively engage a beer keg. A first hose is coupled to the coupler and is in fluid communication with the coupler. A sensor is coupled to the first hose, and the sensor has a sensor housing and a flow sensor coupled to the sensor housing. The sensor housing has an input aperture coupled to the first hose and an output aperture. The input and the output aperture are in fluid communication with the first hose. The flow sensor is in operational communication with the sensor housing and is configured to detect flow volume and pressure of beer passing from the input aperture to the output aperture. A battery is coupled to the sensor housing, and the battery is in operational communication with the sensor. A second hose is coupled to the sensor. The second hose is coupled to the output aperture and is in fluid communication with the output aperture and is configured to couple to a tap faucet of a tap tower. An indicator is coupled to the sensor. The indicator has a wire coupled to the sensor and a light housing coupled to the wire. The light housing has an LED light coupled therein and is configured to couple within the tap tower below the tap faucet with the LED light visible through a light aperture of the tap tower. The LED light is in operational communication with the sensor to shine green when pressure and volume detected indicate the beer keg is good, orange when pressure and volume detected indicate the beer keg is nearing empty, and alternatively red when the pressure and volume detected indicate the beer keg is empty.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
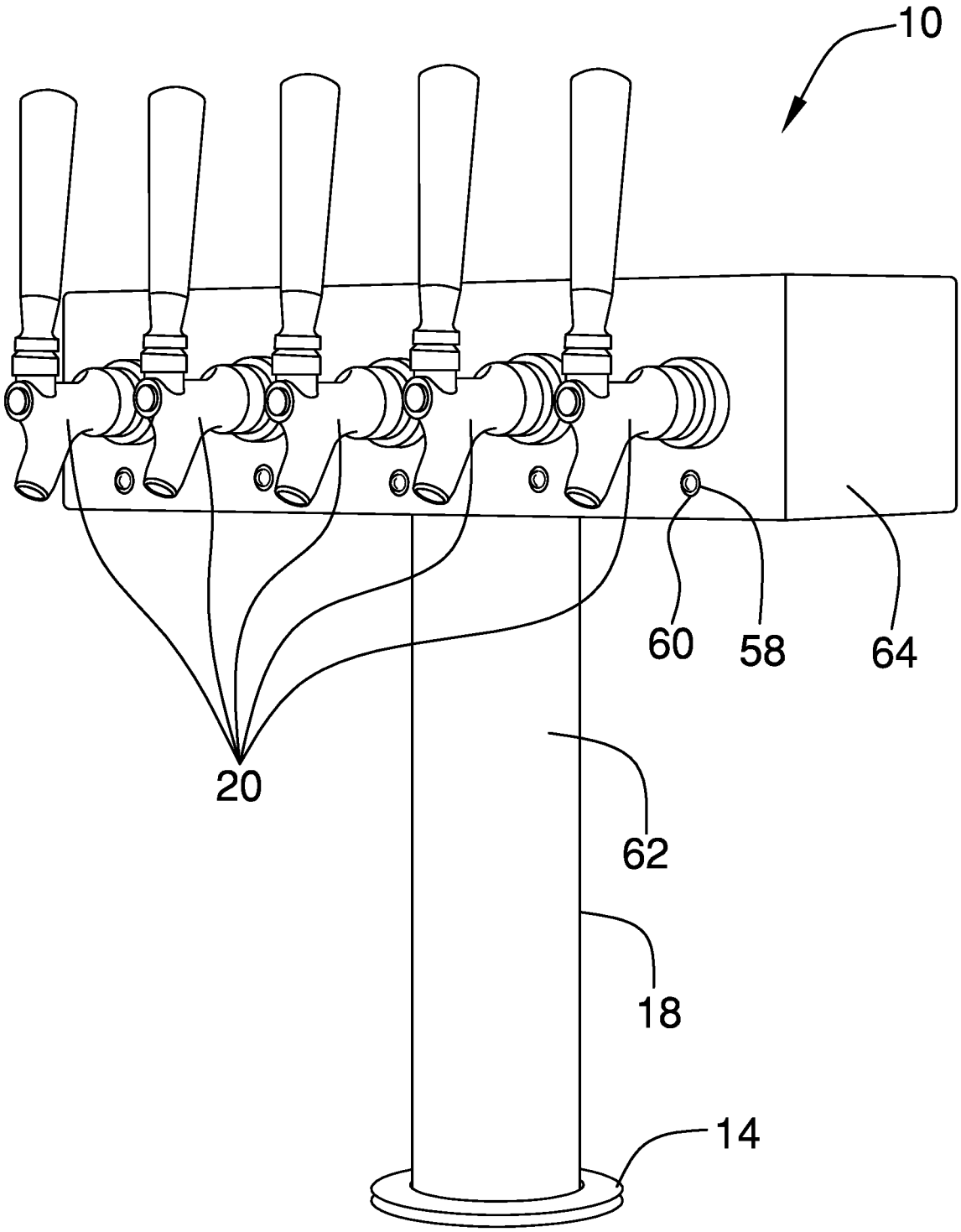
FIG. 1 is an isometric view of a tap tower and keg tap alert system combination according to an embodiment of the disclosure.
Figure 2:
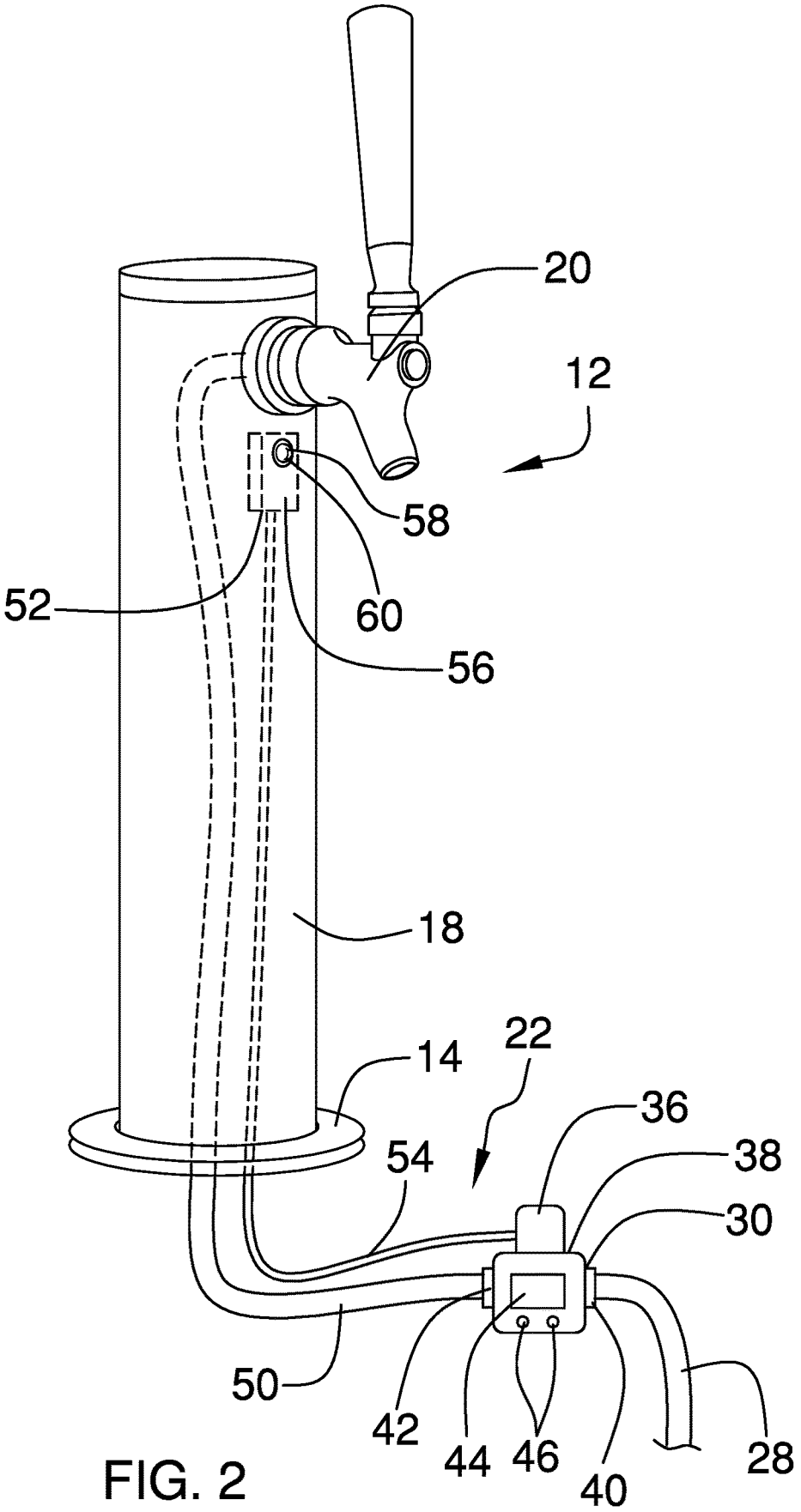
FIG. 2 is an isometric view of an embodiment of the disclosure.
Figure 3:
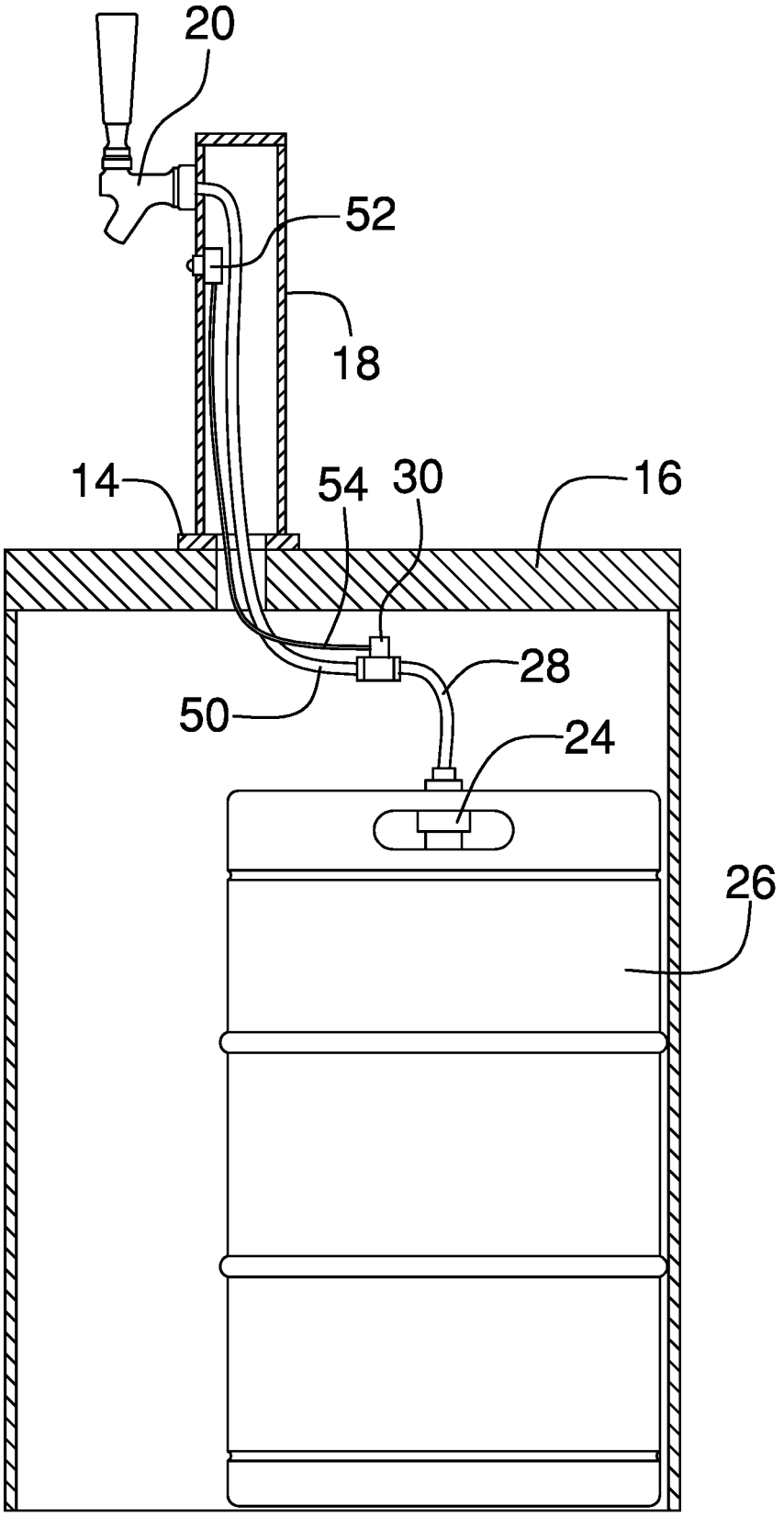
FIG. 3 is a cross-sectional view of an embodiment of the disclosure.
Figure 4:
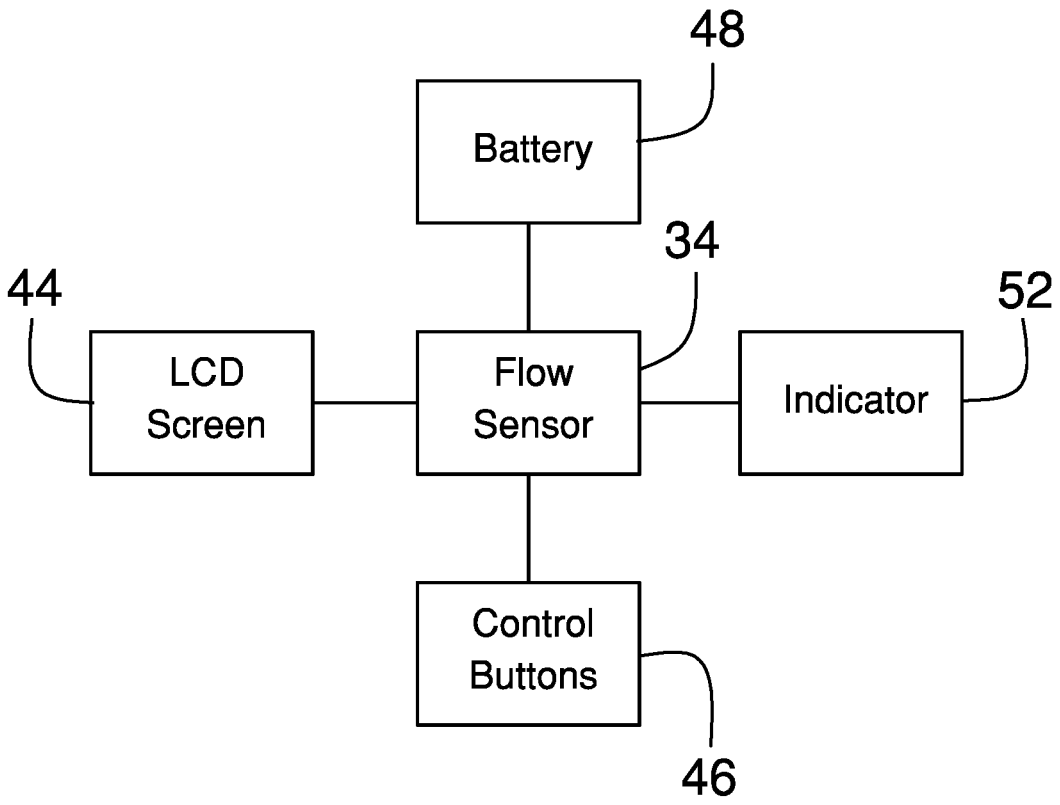
FIG. 4 is a block diagram of an embodiment of the disclosure.

With reference now to the drawings, and in particular to FIGS. 1 through 4 thereof, a new keg tap embodying the principles and concepts of an embodiment of the disclosure and generally designated by the reference numeral 10 will be described.

As best illustrated in FIGS. 1 through 4, the tap tower and keg tap alert system combination 10 generally comprises a tap tower 12 which comprises a base 14 that is configured to couple to a bar 16, a tower body 18 that is coupled to the base 14, and at least one faucet 20 that is coupled to the tower body 18. The tap tower and keg tap alert system combination 10 further comprises at least one keg tap alert system 22. Each faucet 20 of the tap tower 12 has one keg tap alert system 22. Each of the keg tap alert systems 22 comprise a coupler 24 that is configured to selectively engage a beer keg 26 and a first hose 28 that is coupled to the coupler 24. The first hose 28 is in fluid communication with the coupler 24. A sensor 30 is coupled to the first hose 28. The sensor 30 has a sensor housing 32 and a flow sensor 34 that is coupled to the sensor housing 32. The sensor housing 32 has rounded corners. The flow sensor 34 has a sensor head 36 extending from a top side 38 of the sensor housing 32. The sensor housing 32 has an input aperture 40 coupled to the first hose 28 and an output aperture 42. The input aperture 40 and the output aperture 42 are in fluid communication with the first hose 28. The flow sensor 34 is in operational communication with the sensor housing 32 and is configured to detect flow volume and pressure of beer passing from the input aperture 40 to the output aperture 42. The sensor 30 has an LCD screen 44 and a plurality of control buttons 46. The LCD screen 44 and the plurality of control buttons 46 are in operational communication with the flow sensor 34 and a battery 48 to display pressure and volume readings. The battery 48 is coupled to the sensor housing 32, and the battery 48 is in operational communication with the sensor 30. A second hose 50 is coupled to the sensor 30 and is coupled to the output aperture 42. The second hose 50 is in fluid communication with the output aperture 42 and is coupled to the tap faucet 20 of the tap tower 12. An indicator 52 is coupled to the sensor 30. The indicator 52 has a wire 54 coupled to the sensor head 36 and a light housing 56 coupled to the wire 54. The light housing 56 is rectangular prismatic, has an LED light 58 coupled therein, and is configured to couple within the tower body 18 below the tap faucet 20 with the LED light 58 visible through a light aperture 60 of the tower body 18. The LED light 58 is in operational communication with the sensor 30 to shine green when pressure and volume detected indicate the beer keg 26 is good, orange when pressure and volume detected indicate the beer keg 26 is nearing empty, and alternatively red when the pressure and volume detected indicate the beer keg 26 is empty. The LCD screen 44 and the plurality of control buttons 46 are in operational communication with the indicator 52 to set the pressure and volume levels corresponding to each color of the LED light 58.

The tap tower and keg tap alert system combination 10 base 14 is circular, and the tower body 18 has a cylindrical portion 60 coupled to the base 14 and rectangular prismatic top portion 62 coupled to the cylindrical portion 60. The at least one faucet 20 is coupled to the top portion 62. The at least one faucet 20 may also be at least five faucets 20.

In use, the user engages the tap faucet 20 to move beer through the flow sensor 34 in the first hose 28. The LED light 58 shines green, orange, and alternatively, red, when pressure and volume detected indicate the beer keg is good, nearing empty, and empty, respectively.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A keg tap alert system comprising:

a coupler, the coupler being configured to selectively engage a beer keg;

a first hose coupled to the coupler, the first hose being in fluid communication with the coupler;

a sensor coupled to the first hose, the sensor having a sensor housing and a flow sensor coupled to the sensor housing, the sensor housing having an input aperture coupled to the first hose and an output aperture, the input aperture and the output aperture being in fluid communication with the first hose, the flow sensor being in operational communication with the sensor housing and configured to detect flow volume and pressure of beer passing from the input aperture to the output aperture;

a battery coupled to the sensor housing, the battery being in operational communication with the sensor;

a second hose coupled to the sensor, the second hose being coupled to the output aperture, the second hose being in fluid communication with the output aperture and configured to couple to a tap faucet of a tap tower; and an indicator coupled to the sensor, the indicator having a wire coupled to the sensor and a light housing coupled to the wire, the light housing having an LED light coupled therein and being configured to couple within the tap tower below the tap faucet with the LED light visible through a light aperture of the tap tower, the LED light being in operational communication with the sensor to shine green when pressure and volume detected indicate the beer keg is good, orange when pressure and volume detected indicate the beer keg is nearing empty, and alternatively red when the pressure and volume detected indicate the beer keg is empty.

2. The keg tap alert system of claim 1 further comprising the sensor having an LCD screen and a plurality of control buttons, the LCD screen and the plurality of control buttons being in operational communication with the flow sensor and the battery to display pressure and volume readings, the LCD screen and the plurality of buttons being in operational communication with the indicator to set the pressure and volume levels corresponding to each color of the LED light.

3. The keg tap alert system of claim 2 further comprising the plurality of buttons being a pair of buttons.

4. The keg tap alert system of claim 1 further comprising the sensor housing having rounded corners, the flow sensor having a sensor head extending from a top side of the sensor housing, the wire being coupled to the sensor head.

5. The keg tap alert system of claim 1 further comprising the light housing being rectangular prismatic.

6. A tap tower and keg tap alert system combination comprising:

a tap tower, the tap tower comprising:

a base, the base being configured to couple to a bar;

a tower body coupled to the base; and at least one faucet coupled to the tower body;

at least one keg tap alert system, each faucet of the tap tower having one keg tap alert system, each of the keg tap alert systems comprising:

a coupler, the coupler being configured to selectively engage a beer keg;

a first hose coupled to the coupler, the first hose being in fluid communication with the coupler;

a sensor coupled to the first hose, the sensor having a sensor housing and a flow sensor coupled to the sensor housing, the sensor housing having an input aperture coupled to the first hose and an output aperture, the input and the output aperture being in fluid communication with the first hose, the flow sensor being in operational communication with the sensor housing and configured to detect flow volume and pressure of beer passing from the input aperture to the output aperture;

a battery coupled to the sensor housing, the battery being in operational communication with the sensor;

a second hose coupled to the sensor, the second hose being coupled to the output aperture, the second hose being in fluid communication with the output aperture and coupled to the tap faucet of the tap tower; and an indicator coupled to the sensor, the indicator having a wire coupled to the sensor and a light housing coupled to the wire, the light housing having an LED light coupled therein and being configured to couple within the tower body below the tap faucet with the LED light visible through a light aperture of the tower body, the LED light being in operational communication with the sensor to shine green when pressure and volume detected indicate the beer keg is good, orange when pressure and volume detected indicate the beer keg is nearing empty, and alternatively red when the pressure and volume detected indicate the beer keg is empty.

7. The tap tower and keg tap alert system combination of claim 6 further comprising the sensor having an LCD screen and a plurality of control buttons, the LCD screen and the plurality of control buttons being in operational communication with the flow sensor and the battery to display pressure and volume readings, the LCD screen and the plurality of buttons being in operational communication with the indicator to set the pressure and volume levels corresponding to each color of the LED light.

8. The tap tower and keg tap alert system combination of claim 7 further comprising the plurality of buttons being a pair of buttons.

9. The tap tower and keg tap alert system combination of claim 6 further comprising the sensor housing having rounded corners, the flow sensor having a sensor head extending from a top side of the sensor housing, the wire being coupled to the sensor head.

10. The tap tower and keg tap alert system combination of claim 6 further comprising the light housing being rectangular prismatic.

11. The tap tower and keg tap alert system combination of claim 6 further comprising the base being circular and the tower body being cylindrical.

12. The tap tower and keg tap alert system combination of claim 6 further comprising the base being circular, the tower body having a cylindrical portion coupled to the base and rectangular prismatic top portion coupled to the cylindrical portion, the at least one faucet being coupled to the top portion.

13. The tap tower and keg tap alert system combination of claim 12 further comprising the at least one faucet being at least five faucets.

14. A tap tower and keg tap alert system combination comprising:

a tap tower, the tap tower comprising:

a base, the base being configured to couple to a bar;

a tower body coupled to the base; and at least one faucet coupled to the tower body;

at least one keg tap alert system, each faucet of the tap tower having one keg tap alert system, each of the keg tap alert systems comprising:

a coupler, the coupler being configured to selectively engage a beer keg;

a first hose coupled to the coupler, the first hose being in fluid communication with the coupler;

a sensor coupled to the first hose, the sensor having a sensor housing and a flow sensor coupled to the sensor housing, the sensor housing having rounded corners, the flow sensor having a sensor head extending from a top side of the sensor housing, the sensor housing having an input aperture coupled to the first hose and an output aperture, the input aperture and the output aperture being in fluid communication with the first hose, the flow sensor being in operational communication with the sensor housing and configured to detect flow volume and pressure of beer passing from the input aperture to the output aperture, the sensor having an LCD screen and a plurality of control buttons, the LCD screen and the plurality of control buttons being in operational communication with the flow sensor to display pressure and volume readings;

a battery coupled to the sensor housing, the battery being in operational communication with the sensor;

a second hose coupled to the sensor, the second hose being coupled to the output aperture, the second hose being in fluid communication with the output aperture and coupled to the tap faucet of the tap tower; and an indicator coupled to the sensor, the indicator having a wire coupled to the sensor head and a light housing coupled to the wire, the light housing being rectangular prismatic, the light housing having an LED light coupled therein and being configured to couple within the tower body below the tap faucet with the LED light visible through a light aperture of the tower body, the LED light being in operational communication with the sensor to shine green when pressure and volume detected indicate the beer keg is good, orange when pressure and volume detected indicate the beer keg is nearing empty, and alternatively red when the pressure and volume detected indicate the beer keg is empty, the LCD screen and the plurality of buttons being in operational communication with the indicator to set the pressure and volume levels corresponding to each color of the LED light.

15. The tap tower and keg tap alert system combination of claim 14 further comprising the base being circular and the tower body being cylindrical.

16. The tap tower and keg tap alert system combination of claim 15 further comprising the base being circular, the tower body having a cylindrical portion coupled to the base and rectangular prismatic top portion coupled to the cylindrical portion, the at least one faucet being coupled to the top portion.

17. The tap tower and keg tap alert system combination of claim 16 further comprising the at least one faucet being at least five faucets.

* * * * *